US010761487B2

(12) United States Patent
Kim

(10) Patent No.: US 10,761,487 B2
(45) Date of Patent: Sep. 1, 2020

(54) CONVERTIBLE SMART WATCH

(71) Applicant: Seung Jae Kim, Seoul (KR)

(72) Inventor: Seung Jae Kim, Seoul (KR)

( * ) Notice: Subject to any disclaimer, the term of this patent is extended or adjusted under 35 U.S.C. 154(b) by 71 days.

(21) Appl. No.: 15/750,931

(22) PCT Filed: Sep. 13, 2016

(86) PCT No.: PCT/KR2016/010309
§ 371 (c)(1),
(2) Date: Feb. 7, 2018

(87) PCT Pub. No.: WO2017/048035
PCT Pub. Date: Mar. 23, 2017

(65) Prior Publication Data

US 2018/0231939 A1 Aug. 16, 2018

(30) Foreign Application Priority Data

Sep. 15, 2015 (KR) ..... 10-2015-0130364
Sep. 15, 2015 (KR) ..... 20-2015-0006161 U

(51) Int. Cl.
*G04B 37/14* (2006.01)
*G04G 17/08* (2006.01)
(Continued)

(52) U.S. Cl.
CPC ..... *G04B 37/14* (2013.01); *G04B 19/04* (2013.01); *G04B 37/1426* (2013.01);
(Continued)

(58) Field of Classification Search
CPC ..... G04B 37/14; G04B 19/04; G04B 45/00; G04B 37/1426; G04G 17/08; G04G 21/08; G04G 21/02; G04G 17/045
See application file for complete search history.

(56) References Cited

U.S. PATENT DOCUMENTS 1,930,416 A * 10/1933 Chauvot ..... G04B 37/0427 368/281
4,444,513 A * 4/1984 Proellochs ..... G04B 37/0427 368/223
(Continued)

FOREIGN PATENT DOCUMENTS

JP 63-044789 Y2 11/1988
JP 2002-139577 A 5/2002
(Continued)

OTHER PUBLICATIONS

International Search Report for PCT/KR2016/010309 dated Jan. 20, 2017 from Korean Intellectual Property Office.

*Primary Examiner* — Sean Kayes
(74) *Attorney, Agent, or Firm* — Paratus Law Group, PLLC

(57) ABSTRACT

A convertible smart watch including a smart watch and an analog watch together, which is convertible between the smart watch and the analog watch at user's option, is disclosed. The convertible smart watch includes a frame with a through hole in the center, a watch body including an analog watch unit and a smart watch unit combined against their backs such that that analog watch be exposed to one side and the smart watch be exposed to the other side, which is rotatable inside the through hole of the frame, and a smart watch on-off unit to operate the smart watch unit, when the smart watch is exposed to the front of the frame and the analog watch is exposed to the rear of the frame.

4 Claims, 10 Drawing Sheets

(51) Int. Cl.

| | |
|---|---|
| ***G04G 21/08*** | (2010.01) |
| ***G04B 45/00*** | (2006.01) |
| ***G04G 21/02*** | (2010.01) |
| ***G04B 19/04*** | (2006.01) |
| ***G04G 17/04*** | (2006.01) |

(52) U.S. Cl.

CPC ..... *G04B 45/00* (2013.01); *G04G 17/045* (2013.01); *G04G 17/08* (2013.01); *G04G 21/02* (2013.01); *G04G 21/08* (2013.01)

(56) References Cited

U.S. PATENT DOCUMENTS

| | | | | | |
|---|---|---|---|---|---|
| 4,493,561 | A * | 1/1985 | Bouchet | G04B 37/0472 368/223 |
| D283,913 | S * | 5/1986 | Tomlinson | 123/41.65 |
| 4,597,138 | A * | 7/1986 | Hirsch | A44C 5/14 24/265 B |
| 4,985,878 | A * | 1/1991 | Yamada | G04B 37/0472 368/223 |
| 5,262,763 | A * | 11/1993 | Okuyama | G04G 9/0064 345/169 |
| 6,779,917 | B1 | 8/2004 | Chappuis | |
| 2006/0018202 | A1 | 1/2006 | Girardin et al. | |
| 2007/0274163 | A1 * | 11/2007 | Wild | G04B 37/0427 368/316 |
| 2019/0155222 | A1 * | 5/2019 | Kim | G04G 17/04 |

FOREIGN PATENT DOCUMENTS

| | | | |
|---|---|---|---|
| JP | 2003-505706 | A | 2/2003 |
| KR | 20-0346640 | Y1 | 4/2004 |
| KR | 10-2005-0120691 | A | 12/2005 |

* cited by examiner

CONVERTIBLE SMART WATCH

CROSS REFERENCE TO PRIOR APPLICATIONS

This application is a National Stage Patent Application of PCT International Patent Application No. PCT/KR2016/010309 (filed on Sep. 13, 2016) under 35 U.S.C. § 371, which claims priority to Korean Patent Application Nos. 10-2015-0130364 (filed on Sep. 15, 2015) and 20-2015-0006161 (filed on Sep. 15, 2015), which are all hereby incorporated by reference in their entirety.

TECHNICAL FIELD

Example embodiments of inventive concepts may be applicable to a convertible smart watch, and more particularly, to a convertible smart watch which is freely convertible from smart watch to analogue watch and vice versa.

BACKGROUND ART

A smart watch is an embedded system wrist watch which has advanced functions compared to general watches. Initially, the embedded functions were calculating, translating, and playing games together with displaying time. But, presently, the functions may include various functions driven by mobile applications as well as phone call, receiving/sending voice and text messages, and playing audio and video files. Present smart watch generally includes camera, accelerometer, thermometer, altimeter, barometer, compass, chronograph, touch screen, touch screen, GPS, SD card, and chargeable and dischargeable battery.

The smart watch includes a display panel for performing functions and checking information. The design including a display panel may arouse ethnic sense of future oriented, but users who are accustomed to the traditional ethnic sense of analog watch having an hour hand and a minute hand may not choose the design.

So, a smart watch which is designed to look like an analog watch displaying a rotating hour hand a rotating minute hand is being required. But it is still hard to reproduce traditional ethnic sense of analog watch. In addition, checking time may be impossible when wireless communication condition is bad or a battery is discharged.

DETAILED DESCRIPTION OF THE INVENTION

Technical Goal of the Invention

According to an exemplary embodiment, the inventive concept provides a convertible smart watch combining smart watch and analog watch, which is convertible from smart watch to analog watch and vice versa.

Technical Solution of the Invention

According to an exemplary embodiment of the inventive concept, a convertible smart watch includes a watch body, a frame, and a bracket. The watch unit combines an analog watch unit and a smart watch unit. Accordingly, one side of the watch body shows an analog watch and the other side of the watch body shows a smart watch.

The frame is inserted by the watch body so as to be detachable. The center of the frame includes one of a groove and a through hole.

One terminal of the bracket is combined to the watch body and the other terminal of the bracket is combined to the frame. At this time, the watch body is combined to the one terminal of the bracket so as to be rotatable. The other terminal of the bracket is combined by hinge to the frame.

The watch body revolves around the other terminal of the bracket between a first position where the one terminal of the bracket being close to the frame and a second position where the one terminal of the bracket being apart from the frame.

One between the analog watch and the smart watch is exposed on the front side of the frame, when the bracket is in the first position, and the watch body is inserted to one of the groove and the through hole of the frame. The other between the analog watch and the smart watch is exposed on the front side of the frame, when the bracket is in the second position, and the watch body rotates a 180 degree around the one terminal of the bracket such that the bracket returns to the first position.

The side of the watch body includes a guide groove extended from one terminal of the watch body to the other terminal of the watch body. The one terminal of the bracket includes a connection bump to be inserted into the guide groove. Accordingly, the watch body is rotatable around the connection bump and possible to move location with respect to the bracket while sliding as the guide groove being combined to the connection bump.

The guide groove may be formed on the both sides of the watch body, respectively, in a pair. The bracket including the connection bump may be formed in a pair so as to be combined to the bracket pair one-to-one. The bracket may be inserted into the groove or the through hole of the frame at the first position.

The convertible smart watch further includes a smart watch on-off unit which operates the smart watch unit only when the smart watch being shown to the front of the frame.

The smart watch on-off unit includes an elastic bump and a touch switch. The elastic bump is protruded from one of the frame and the watch body so as to be elastically shortened. The touch switch is formed on one of the frame and the watch body and allows the smart watch unit to operate when being pressed. At this time, the touch switch is pressed by the elastic bump only when the watch body is inserted to one of the groove and the through hole of the frame and the smart watch is exposed to the front of the frame.

The watch body includes a first locking groove to which the terminal of the elastic bump may be inserted. Also, the touch switch is formed inside the first locking groove. At this time, the terminal of the elastic bump may press the touch switch by being inserted to the first locking groove only when the watch body is inserted to one of the groove and through hole of the frame and the smart watch is exposed to the front of the frame.

The watch body includes a second locking groove to which the terminal of the elastic bump may be inserted on the opposite position to the first locking groove. The terminal of the elastic bump is inserted to the second locking groove only when the watch body is inserted to one of the groove and the trough hole of the frame and the analog watch is exposed to the front of the frame.

The watch body is locked to prevent falling off inadvertently, when the terminal of the elastic bump is inserted to one of the first locking groove and the second locking groove.

The convertible smart watch further includes a locking unit for watch body for locking the watch body not to fall off inadvertently from one of the groove and the through hole of the frame at the time that the watch body is inserted to one of the groove and through hole of the frame.

Effect of the Invention

According to the inventive concept, a convertible smart watch includes a smart watch unit and an analog watch unit at the same time standing against their back and is convertible to show between the smart watch and the analog watch. Accordingly, a user may choose a smart watch or an analog watch with just one watch differently for dress, mood of the meeting, and so on.

According to the inventive concept, the convertible smart watch has structure of a watch body being connected to the frame with a bracket such that the smart watch may be converted into the analog watch, or the analog watch may be converted into the smart watch while being worn on the wrist.

Also, the convertible smart watch may show time on the analog watch unit even if the smart watch unit not being available in battery discharge or in bad wireless communication condition.

BEST MODE FOR CARRYING OUT THE INVENTION

Figure 1:
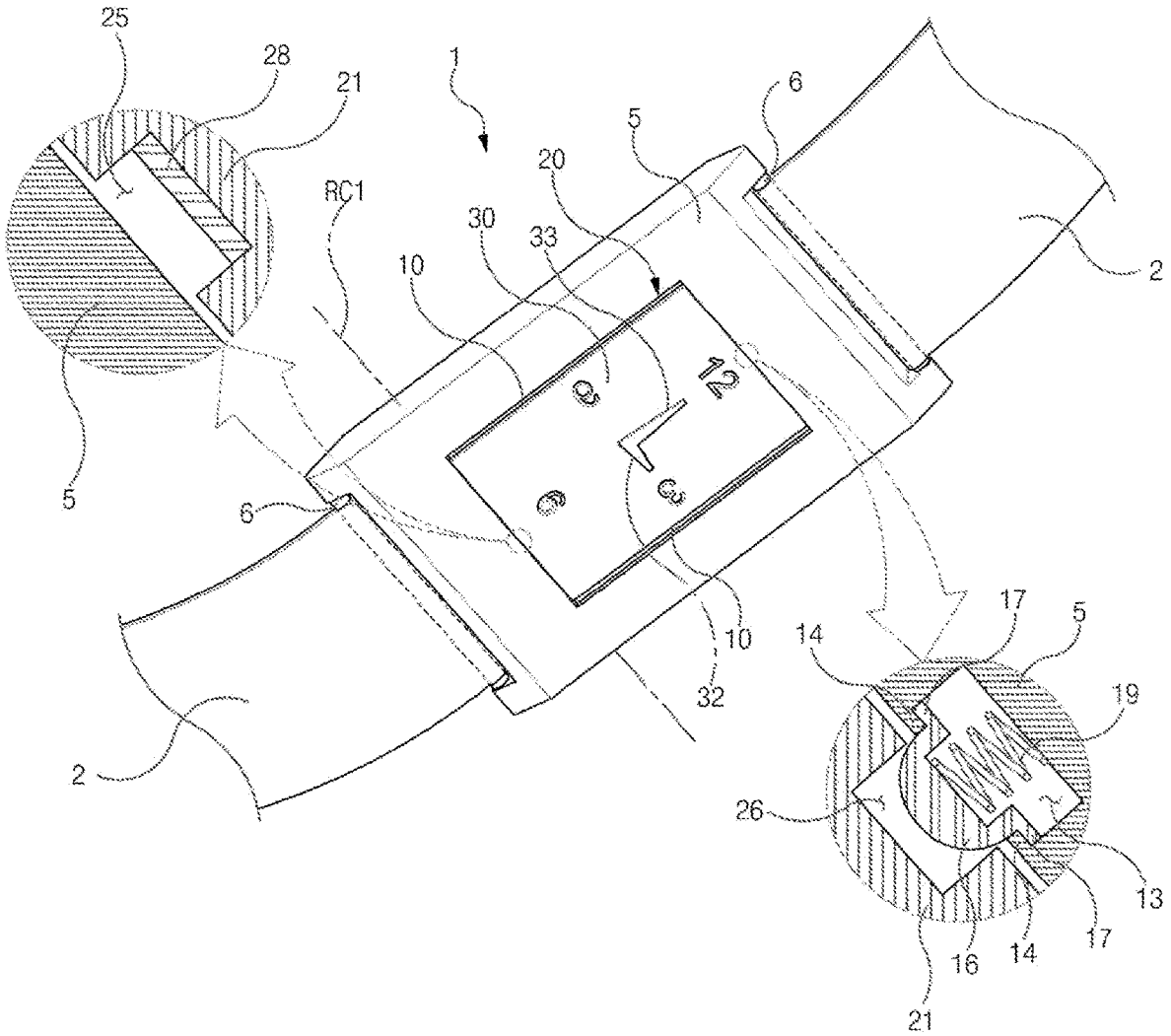
FIGS. 1 through 6 are perspective views illustrating converting process from convertible smart watch to analog watch successively according to an exemplary embodiment of the present inventive concept.

Various example embodiments will be described more fully hereinafter with reference to the accompanying drawings. The terminology used herein is for the purpose of describing particular example embodiments and may be varies according to the user's purpose or conventional custom in the art. Accordingly, definition of the terminology should be interpreted as having a meaning that is consistent with their meaning in the context of the relevant art.

FIGS. 1 through 6 are perspective views illustrating converting process from convertible smart watch to analog watch successively according to an exemplary embodiment of the present inventive concept. Referring to FIGS. 1 through 6, a convertible smart watch 1 includes a frame 5, a watch body 20, and a bracket 10. The frame 5 includes a groove 8 formed in a rectangle shape at the center. The watch body 20 is inserted to the groove 8 so as to be detachable. Both longitudinal ends of the frame 5 include strap supporting bars 6. A strap 2 is connected to strap supporting bars 6 to let frame 5 be worn around the hand. The groove 8 is opened at the front side of the frame 5 and closed at the rear side of the frame 5. A through hole which is opened at both of front side and rear side may be formed instead of the groove 8 to include the watch body 20.

The watch body 20 combines an analog watch unit 30 and a smart watch unit 36 against each back. The watch body 20 shows an analog watch at one side and a smart watch at the other side. The watch body 20 further includes a bezel 21 for wrapping edges of the analog watch unit 30 and the smart watch unit 36. The watch body may be a rectangular shape of thickness being less than width and height.

The analog watch unit 30 tells time through an hour hand 32 and a minute hand 33 rotating on one side of the watch body 20. The analog watch unit 30 includes mechanical movement or quartz movement to spin the hour hand 32 and the minute hand 33.

The smart watch unit 36 tells time by displaying numbers as time on a display panel prepared at the other side of the watch body 20. The smart watch unit 36 may provide various function such as a calculator, a translator, a game console, and so on through mobile applications as well as telling time, phone call, sending/receiving voice and message. The smart watch unit 36 includes a camera, an accelerometer, a thermometer, an altimeter, a barometer, a compass, a chronograph, a touch screen, GPS, an SD card, a chargable/dischargable battery, and so on.

The bracket 10 connects the frame 5 and the watch body 20 and is prepared in a pair to support both sides of the watch body 20. The watch body 20 combines to one side of the each bracket 10 so as to be rotatable.

Specifically, the bezel 21 at the side of the watch body 20 includes a pair of guide grooves 22. The pair of guide grooves 22 are extended from one end to the other end of the watch body 20 in a straight line. The end of each bracket 10 includes a combining bump 11 to be inserted into the pair of guide groove 22.

The watch body 20 is rotatable around the pair of combining bumps 11, when the watch body 20 gets out of the groove 8. And the watch body 20 slides along the pair of the brackets 10 while the pair of combining bumps 11 being joined to the pair of guide grooves 22. Each end in longitudinal direction of the guide groove 22 includes a combining bump arriving groove 23 to receive the combining bump 11.

Meanwhile, the other terminals of the pair of brackets 10 are hinged on the pair of corners inside the groove 8 of the frame 5 although not shown clearly with a hidden view. Accordingly, the pair of bracket 10 is rotatable around the other terminals of the bracket 10 between the first position and the second position. The first position is the position which one terminal of the bracket having the combining bump 11 becomes close to the frame 5. The second position is the position which one terminal of the bracket becomes far from the frame 5. The other terminals of the bracket 10 denotes an imaginary bracket rotating axis RC1 connecting the other terminals of the brackets 10.

Figure 4:
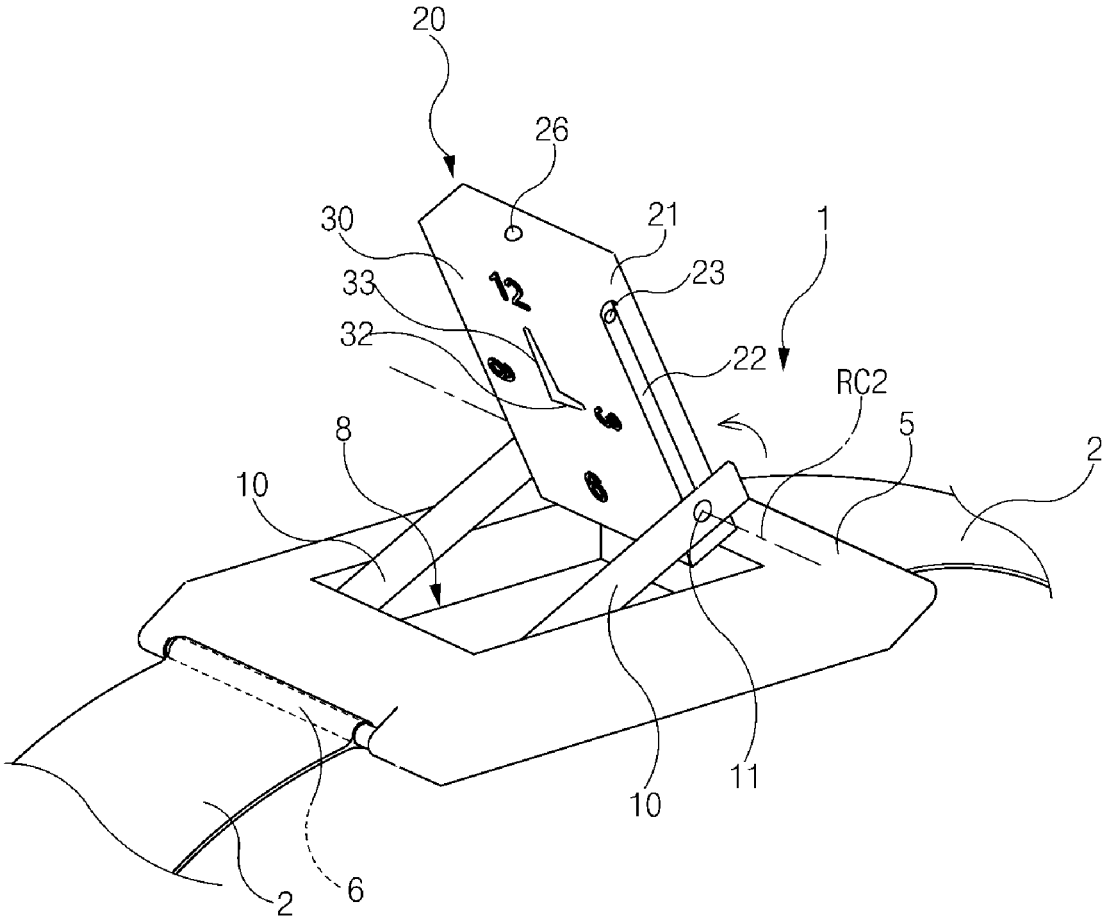
Figure 5:
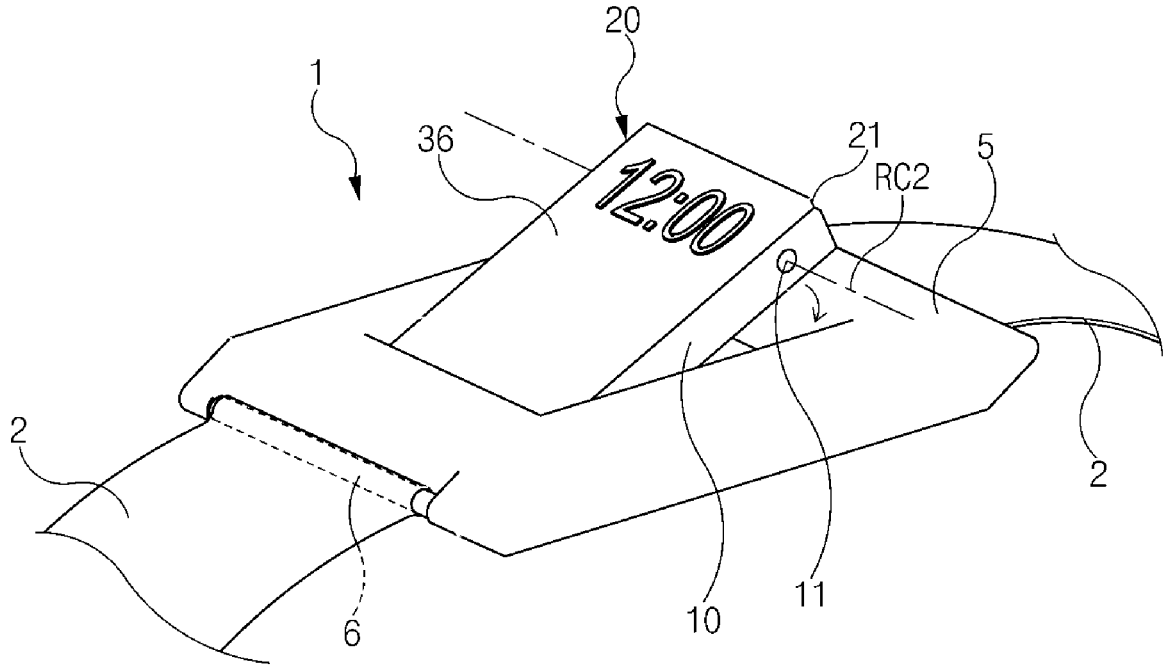
Figure 6:
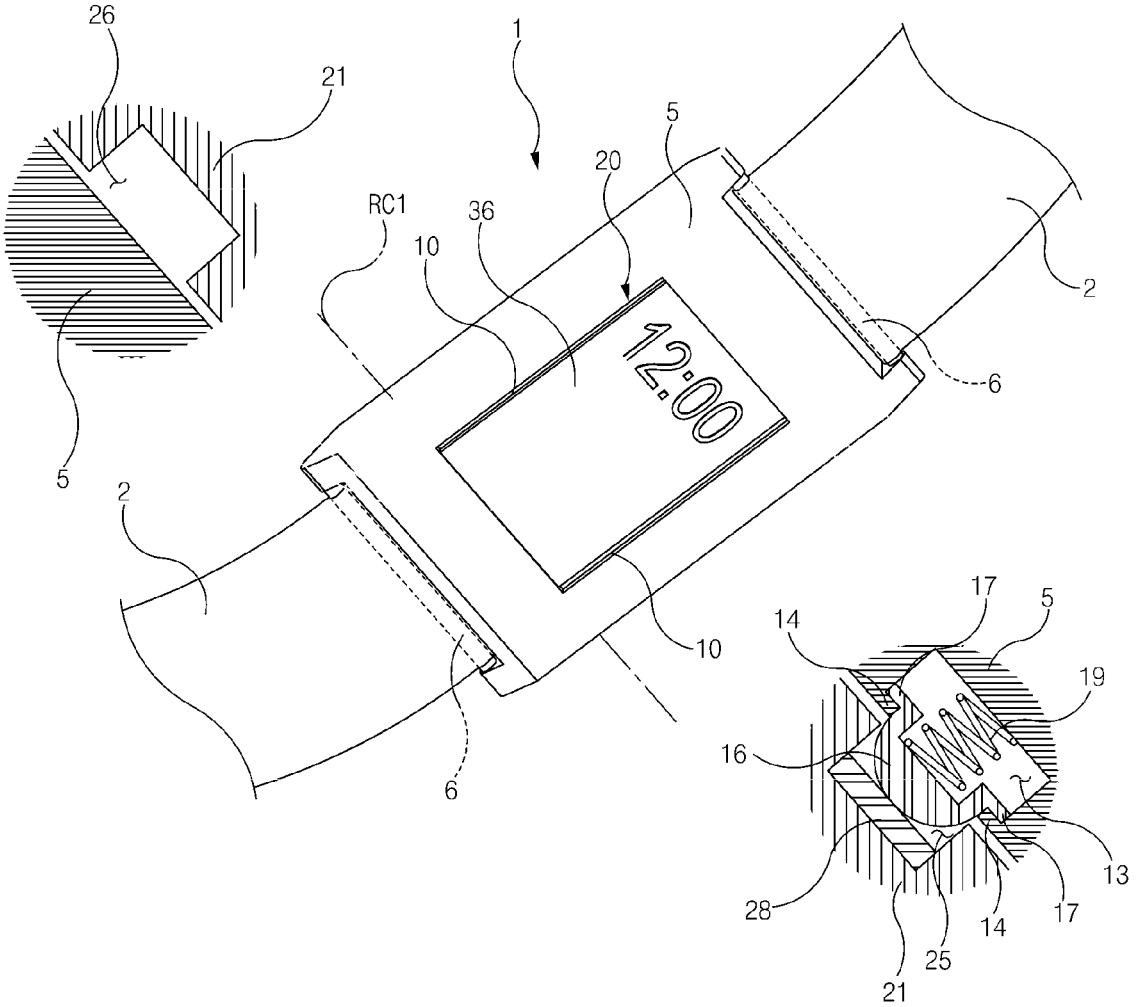

FIGS. 1 and 6 are showing the first position of the brackets 10, and FIGS. 2 through 5 are showing the second position of the brackets 10. As shown in FIGS. 1 and 6, the pair of brackets 10 are inserted to the groove 8 of the frame 5, and one of the analog watch and the smart watch is shown on the front surface of the frame 5 when the watch body 20 being inserted to the groove 8 at the first position.

Figure 2:
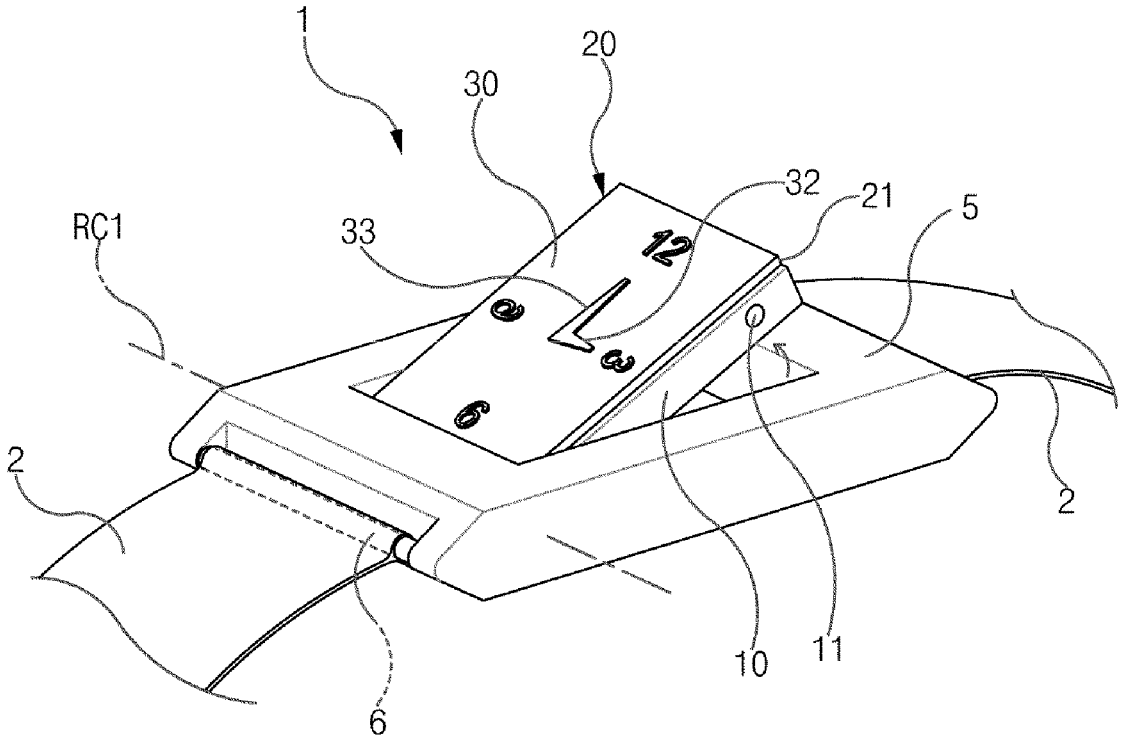
Figure 3:
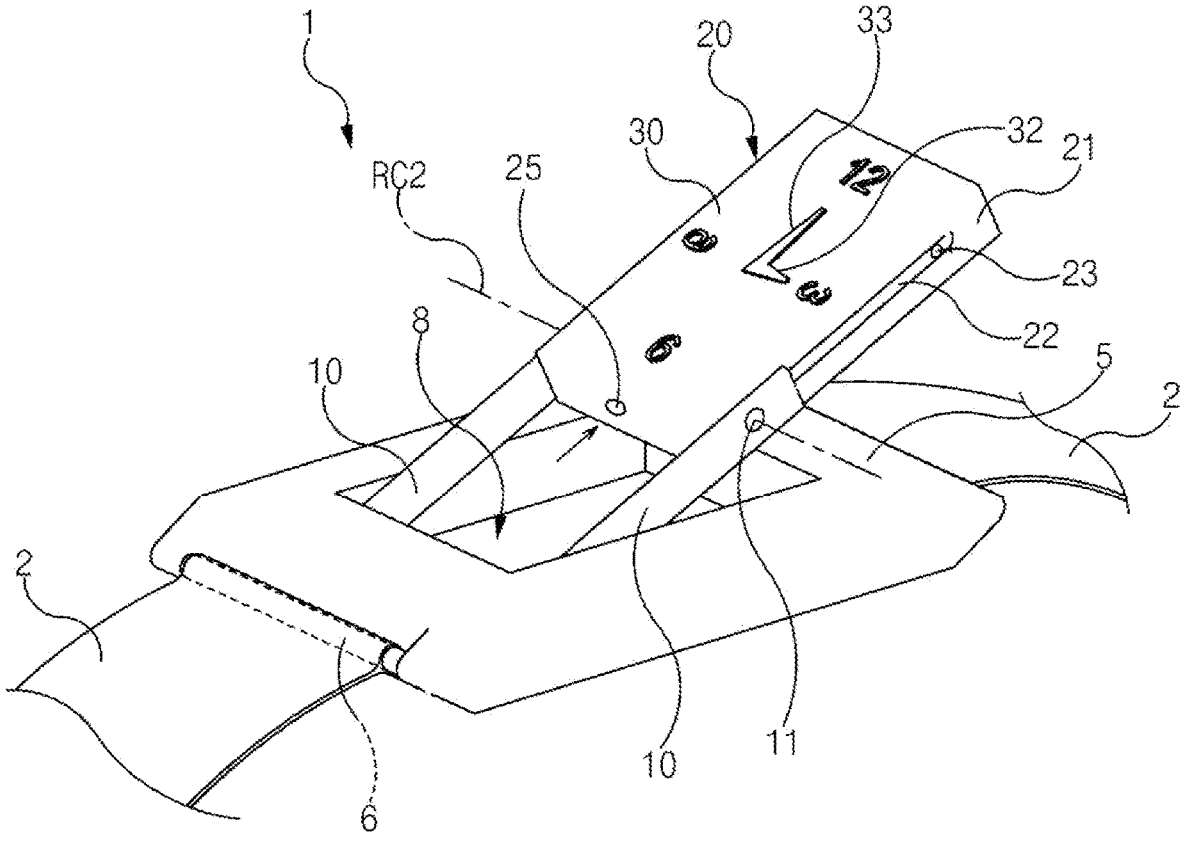

For example, the first position is the position that the watch body 20 is inserted to the groove 8 of the frame 5 while showing the analog watch on the surface of the frame as shown in FIG. 1. At this state, the pair of brackets 10 rotates around the bracket rotating axis RC1 and moves to the second position getting out of the groove 8 as shown in FIG. 2. As shown in FIG. 3., the watch body 20 slides while the combining bump 11 is being combined to the guide groove 22, when the watch body 20 is pulled in direction of being parallel with the extension of the guide groove 22. Accordingly, the watch body 20 moves far from the other terminals of the brackets 10. The combining bump 11 arrived at the combining bump arriving groove 23 of the one terminal of the guide groove 22 moves to the combining bump arriving groove 23 of the other terminal of the guide groove 22.

As shown in FIGS. 4 and 5, the smart watch is shown on the front surface of the frame 5, and the analog watch is hidden, when the watch body rotates around the watch body rotating axis RC2. At this time, the watch body rotating axis RC2 is an imaginary line connecting the pair of combining bumps 11 arrived at the combining bump arriving groove 23 of the other terminal of the guide groove 22.

And, the smart watch is shown on the front surface of the frame 5 while the watch body 20 is being inserted to the groove 8 of the frame 5 unlike FIG. 1, when the pair of brackets 10 rotates around the bracket rotating axis RC1 to turn into the first position as shown in FIG. 6. If a user wants to show the analog watch on the front surface of the frame 5, the opposite procedure to the above description.

Referring to FIGS. 1 and 6 together, the convertible smart watch 1 further includes a smart watch on-off unit. The smart watch unit on-off unit is projected to work only when the smart watch is exposed to the front surface of the frame 5. The smart watch unit on-off unit includes an elastic bump 16 and a touch switch 28.

The elastic bump is formed on any one of inner side surfaces which are not hidden by the pair of brackets among four inner side surfaces of the groove 8 of the frame 5. The elastic bump 16 is inserted to an elastic bump receiving groove 13 which is formed on inner side of the frame 5. The elastic bump 16 is protruded to the center of the groove 8 of the frame 5 and compressed by a spring 16 formed between the bottom surface of the elastic bump receiving groove 13 and the elastic bump 16.

The elastic bump 16 includes a flange 17 extended in a radial direction and a threshold 14 formed around the entrance of the elastic bump receiving groove 13. Accordingly, the elastic bump 16 is protruded to the groove 8 of the frame 5 without leaving from the elastic bump inputting groove 13. Also, once the elastic bump contacts the bezel 21 during the process that the watch body 20 is inserted to the groove 8 of the frame 5 or left from the groove 8, the elastic bump 16 becomes to be inserted into the inside of the elastic bump receiving groove 13.

The touch switch 28 approves operation of the smart watch unit 36 once being contacted and pressed and stops operation of the smart watch unit 36 once not being contacted and pressed. At this time, operation stop of the smart watch unit 36 denotes blocking current to be provided with a display panel formed on one side of the watch body 20 from a chargable/dischargable battery to turn off the display panel for not showing letters or patterns.

The touch switch 28 is formed on the bezel 21 of the watch body 20 so as to be aligned with the elastic bump 16 only when the watch body 20 is inserted in the groove 8. Accordingly, the smart watch unit 36 operates by contacting and pressing the touch switch 28 with the elastic bump 16 only when the watch body 20 is inserted into the groove 8 and the smart watch is shown on the front surface of the frame 5 as show in FIG. 6. On the other hand, the smart watch may not operate when the watch body 20 is close to the groove 8, but the analog watch is shown on the front surface of the frame 5.

The bezel 21 includes a first locking groove 25 and a second locking groove 26. Specifically, the first locking groove 25 is formed at the position aligned with the elastic bump 16 only when the watch body 20 is inserted to the groove 8 such that the smart watch may be exposed to the front surface of the frame 5, and the second locking groove 26 is formed at the position aligned with the elastic bump 16 only when the watch body 20 is inserted to the groove 8 such that the analog watch is exposed to the front surface of the frame 5. The touch switch 28 is formed inside the first locking groove 25.

Accordingly, the watch body 20 is locked so as not to be fallen from the groove 8 of the frame 5 inadvertently by the terminal of the elastic bump 16 being inserted to the first locking groove 25, when the watch body 20 is inserted to the groove 8 of the frame 5 and the smart watch is exposed to the front surface of the frame 5 as shown in FIG. 6. At this time, the touch switch 28 is pressed by the terminal of the elastic bump 16 to operate the smart watch unit 36.

On the other hand, the watch body 20 is locked so as not to be fallen from the groove 8 of the frame 5 inadvertently by the terminal of the elastic bump 16 being inserted to the first locking groove 25, when the watch body 20 is inserted to the groove 8 of the frame 5 and the analog watch is exposed to the front surface of the frame 5 as shown in FIG. 1. At this time, the touch switch 28 is not pressed by the terminal of the elastic bump 16 to not operate the smart watch unit 36.

The elastic bump 16, the first and the second locking groove 25, 26 perform functions as a watch body locking unit. The watch body locking unit locks the watch body 20 so as not to be fallen from the groove 8 in case of being inserted to the groove 8 of the frame 5.

The convertible smart watch 1 shown in FIG. 1 through FIG. 6 includes a watch body locking unit and a smart watch on-off unit together with the touch switch 28 formed inside the first locking groove 25, but the watch body locking unit and the smart watch on-off unit may be formed separately. Meanwhile, the smart watch on-off unit shown in FIGS. 1 and 6 includes the elastic bump 16 formed on the frame and the touch switch 28 formed on the watch body 20, but the elastic bump may be formed on the watch body 20 and the touch switch may be formed on the frame 5.

FIGS. 7 through 10 are perspective view illustrating process of conversion from an analog watch unit to a smart watch unit in a convertible smart watch according to another exemplary embodiment of the present inventive concept. Referring to FIGS. 1 through 10, the convertible smart watch 50 includes a frame 55, a watch body 70, and a smart watch on-off unit. The frame 55 includes a through hole 58 of a rectangular shape in the center so as to load the watch body 70 detachably. The frame 55 includes strap supporting bars 56 and straps 52 for wearing by the wrist at both longitudinal ends.

The watch body 70 combines an analog watch unit 80 and a smart watch unit 86 against each back. The watch body 70 shows an analog watch at one side and a smart watch at the other side. The watch body 70 further includes a bezel 71 for wrapping edges of the analog watch unit 80 and the smart watch unit 86. The watch body 70 may be a rectangular shape of thickness being less than width and height. The watch body 70 is located inside the through hole 58 of the frame 55 so as to rotate around an imaginary rotating axis RC3.

The analog watch unit 80 tells time through an hour hand 82 and a minute hand 83 rotating on one side of the watch body 80. The analog watch unit 80 includes mechanical movement or quartz movement to spin the hour hand 82 and the minute hand 83. The smart watch unit 86 tells time by displaying numbers as time on a display panel prepared at the other side of the watch body 70. The smart watch unit 86 may provide various function such as a calculator, a translator, a game console, and so on through mobile applications as well as telling time, phone call, sending/receiving voice and message. The smart watch unit 36 includes a camera, an accelerometer, a thermometer, an altimeter, a barometer, a compass, a chronograph, a touch screen, GPS, an SD card, a chargable/dischargable battery, and so on.

Figure 7:
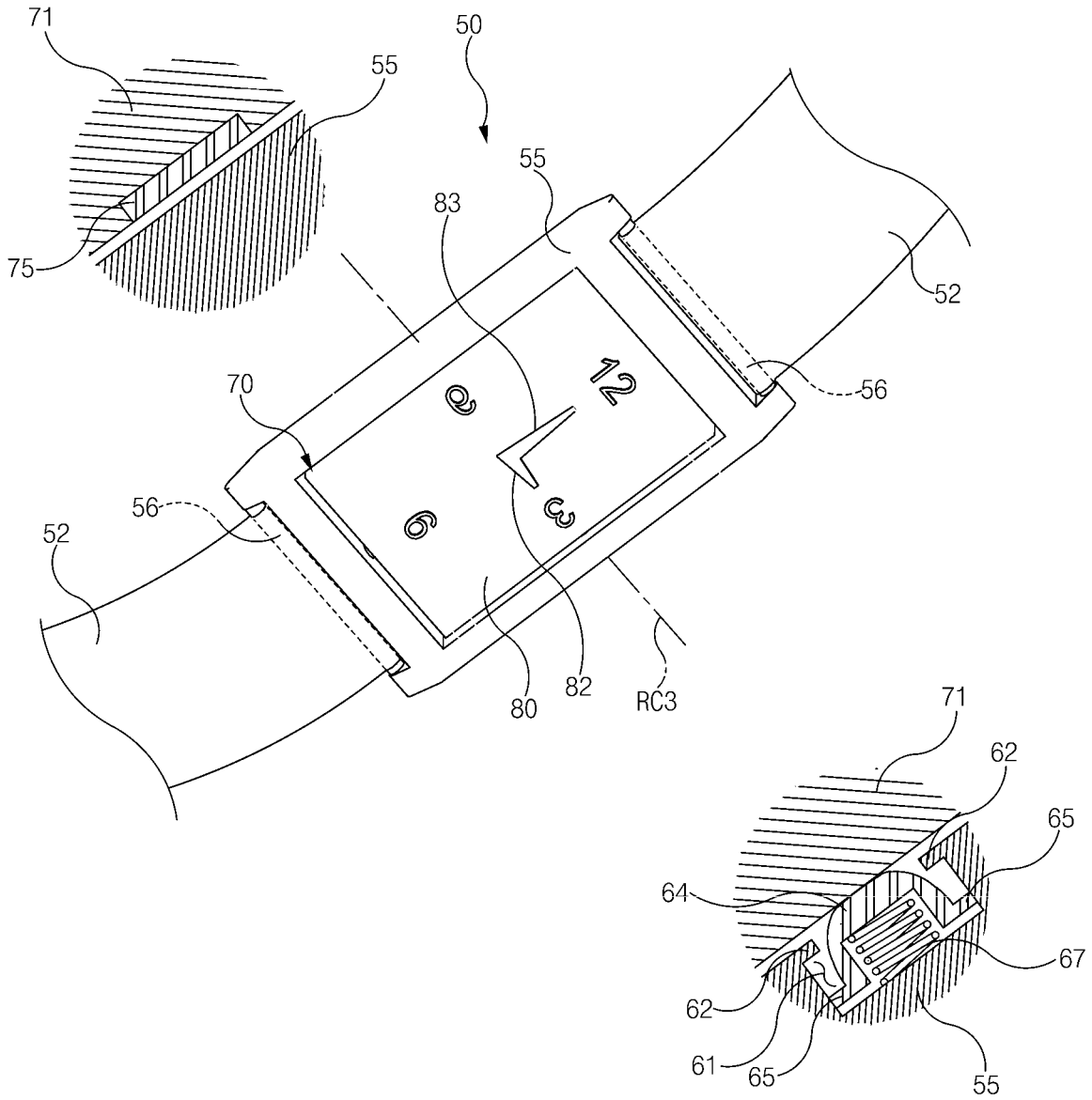
FIGS. 7 through 10 are perspective views illustrating converting process from convertible smart watch to analog watch successively according to another exemplary embodiment of the present inventive concept.
Figure 8:
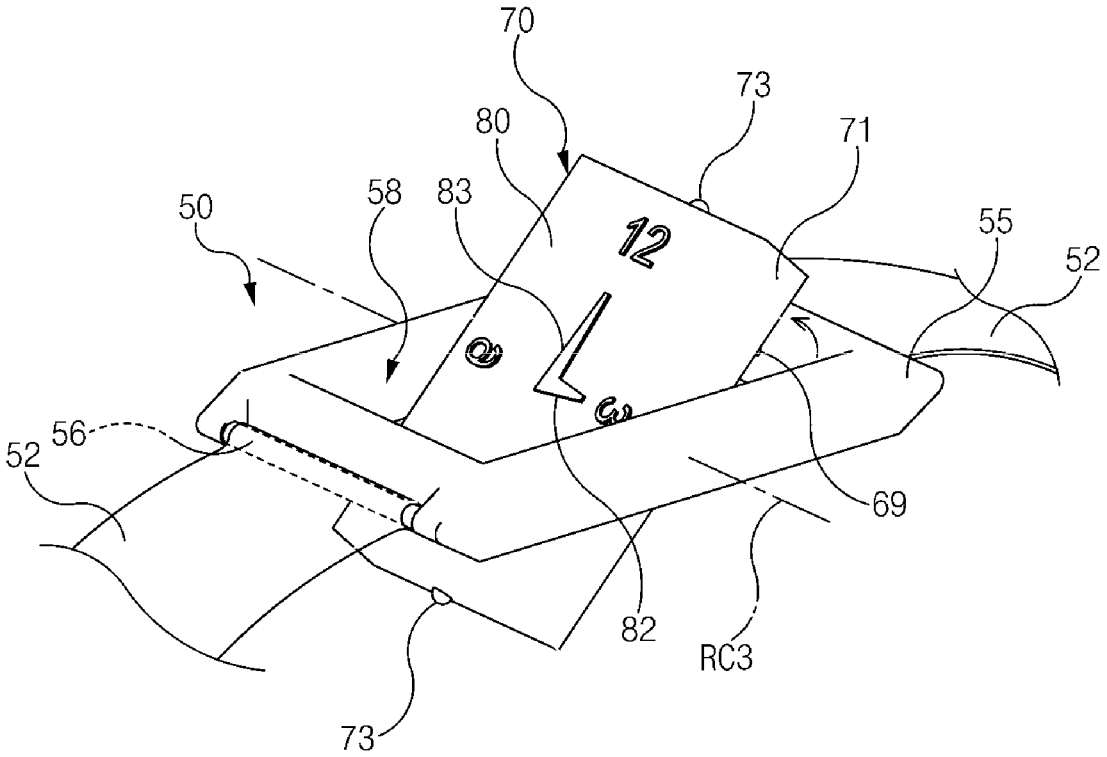
Figure 9:
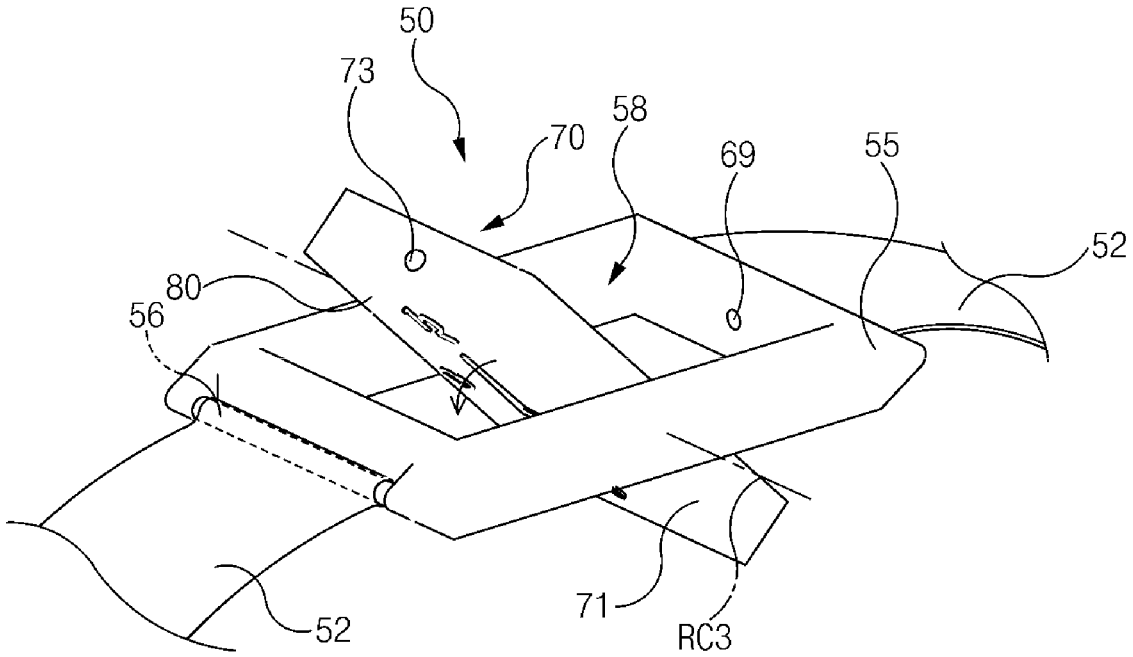
Figure 10:
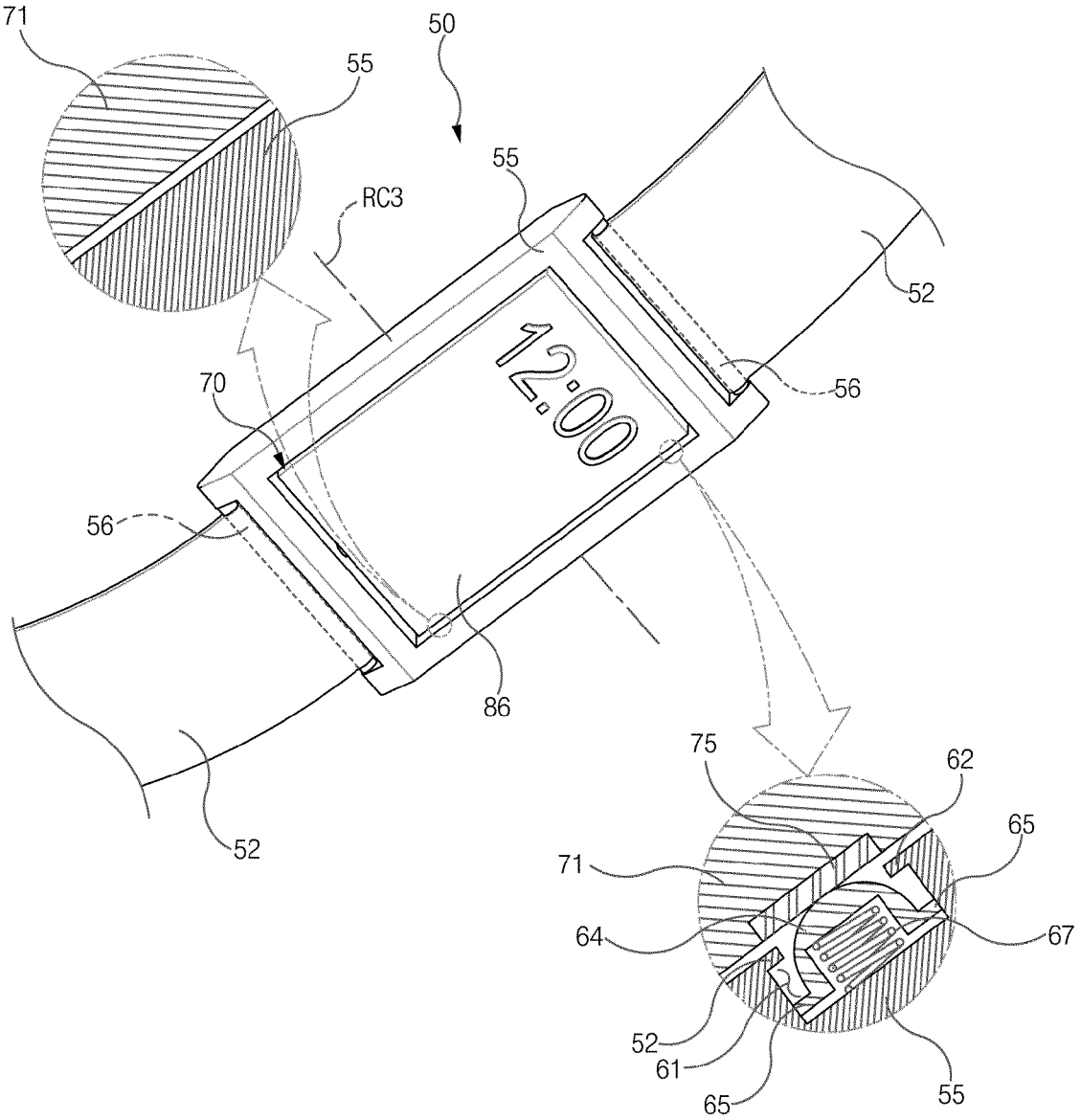

FIG. 7 shows the analog watch on the front of the frame 55 and the smart watch on the rear of the frame 55, and FIG. 10 shows the smart watch on the front of the frame 55 and the analog watch on the rear of the frame 55. As shown in FIGS. 8 and 9, the analog watch and the smart watch are converted with each other, when the watch body 70 is rotated by a half turn around the rotation axis RC3, resulting to show the smart watch on the front of the frame 55 and the analog watch on the rear of the frame 55. The analog watch returns to the front of the frame 55 and the smart watch to the rear of the frame 55, when the watch body 70 is rotated by a half turn around the rotation axis RC3 again from the above state.

The smart watch on-off unit allows the smart watch unit 86 to operate when the smart watch appears on the front of the frame 55 and the analog watch on the rear of the frame 55. Referring to FIGS. 7 and 10, the smart watch unit on-off unit includes an elastic bump 64 and a touch switch 75.

The elastic bump 64 is formed on one inner side of the four inner sides of the through hole 58 of the frame 55 but except on the position overlapping with the rotation axis RC3. The elastic bump 64 is inserted to the elastic bump inserting groove 61 formed inside of the frame 55, and compressed spring 67 is interposed between the floor of the elastic bump inserting groove 61 and the elastic bump 64, such that the elastic bump 64 is protruded toward the center of the through hole 58 of the frame 55 so as to be elastically shrinkable. The elastic bump 64 includes a flange 65 extended in a radial direction and a threshold 62 formed around the entrance of the elastic bump inputting groove 61. Accordingly, the elastic bump 64 is protruded to the through hole 58 of the frame 55 by the terminal without leaving from the elastic bump receiving groove 61. Also, once the elastic bump contacts the bezel 71 during the process that the watch body 70 is rotated around the rotating axis RC3, the elastic bump 64 becomes to be inserted into the inside of the elastic bump receiving groove 61.

The touch switch 75 approves operation of the smart watch unit 86 once being contacted and pressed and stops operation of the smart watch unit 86 once not being contacted and pressed. At this time, operation stop of the smart watch unit 86 denotes blocking current to be provided with a display panel formed on one side of the watch body 70 from a chargable/dischargable battery to turn off the display panel for not showing letters or patterns.

The touch switch 75 is formed on the bezel 71 of the watch body 70 so as to be aligned with the elastic bump 64 when the smart watch appears on the front of the frame 55 and the analog watch appears on the rear of the frame 55. Accordingly, the smart watch unit 86 operates by contacting and pressing the touch switch 75 with the elastic bump 64 when the watch body 70 is disposed in parallel with the frame 55 while not being inclined, and the smart watch appears on the front of the frame 55. However, the smart watch may not operate when the watch body 70 is disposed in parallel with the frame 55 while not being inclined, but the analog watch appears on the front of the frame 55.

The convertible smart watch 50 further includes a watch body locking unit which is projected to lock the watch body 70 so as not to rotate around the rotation axis RC3 inadvertently, when the smart watch appears on the front of the frame 55 and the analog watch appears on the rear of the frame 55, or the analog watch appears on the front of the frame 55 and the smart watch appears on the rear of the frame 55.

Referring to FIGS. 8 and 9, the watch body locking unit includes a pair of locking bumps 73 protruded from the bezel 71 of the watch body 70 so as to be elastically shrunken toward outside and a pair of locking grooves 69 formed so as to receive the terminal of the pair of the locking grooves 73 inside of the through hole 58 of the frame. The locking bump 73 has similar structure with the elastic bump protruded so as to be elastically shrinkable shown in FIGS. 7 and 10.

Although one of the locking bumps 73 and one of the locking grooves 69 are shown in FIGS. 8 and 9, the pair of locking bumpts 73 are prepared in positions symmetrical to with each other with respect to the rotating axis RC3. Accordingly, the watch body 70 is disposed in parallel with the frame 55 without not being tilted, and the terminal of the pair of locking bumps 73 are inserted to the pair of locking groove 69, when one of the smart watch and the analog watch appears on the front of the frame 55, and one of the smart watch and the analog watch appears on the rear of the frame 55, resulting that the watch body 70 may not be rotated around the rotating axis RC3 in advertently.

The convertible smart watch 50 shown in FIGS. 7 through 10 has the watch body locking unit and the smart watch on-off unit separately, but the watch body locking unit and the smart watch on-off unit may be united in other embodiments. Meanwhile, the watch body locking unit shown in FIGS. 7 and 10 has the locking bumps 73 on the watch body 70 and the locking grooves 69 on the frame 55, but the watch body locking unit may has the locking bumps on the frame 55 and the locking grooves 69 on the watch body 70.

While the present invention has been particularly shown and described with reference to exemplary embodiments thereof, it will be understood that various changes in form and details may be made therein without departing from the spirit and scope of the following claims.

INDUSTRIAL USABILITY

The present invention is applicable to a smart watch or a wrist watch.

What is claimed is:

1. A convertible smart watch comprising:

a watch body including a first face equipped with an analog watch unit, and a second surface equipped with a smart watch unit and opposite to the first face;

a frame having a groove or a through hole formed at a center thereof so as to load or unload the watch body;

a bracket having a first end to which the rotatable watch body is rotatably coupled, and a second end opposite to the first end and coupled to the frame with a hinge, wherein the bracket is rotatable about the hinge between a first position that the first end is positioned inside the frame and a second position that the first end is positioned outside the frame; and a smart watch on-off unit configured to operate the smart watch unit only when the smart watch is exposed to a front of the frame, including:

an elastic bump protruded so as to be pressed on one of the frame and the watch body;

a touch switch formed on the other one of the frame and the watch body, and which allows the smart watch unit to operate when being pressed by a terminal of the elastic bump;

a first locking groove formed on the other one of the frame and the watch body and on which the touch switch seats; and a second locking groove formed on the other one of the frame and the watch body at a position opposite to the first locking groove, wherein one of the analog watch unit and the smart watch unit is exposed to the front of the frame when the watch body is inserted in the groove or the through hole of the frame at the first position;

wherein the other one of the analog watch unit and the smart watch unit is exposed to the front of the frame after moving the bracket to the second position and then rotate the watch body by a half turn around the first end of the bracket, and returning the bracket to the first position, and wherein the terminal of the elastic bump is inserted in to the first locking groove and presses the touch switch at a position that the smart watch unit is seated to be exposed to the front of the frame, and the terminal of the elastic bump is inserted into the second locking groove at a position that the analog watch unit is seated to be exposed to the front of the frame.

2. The convertible smart watch of claim 1, wherein the watch body includes a guide groove extended from one end to the other end on a side of the watch body, and the bracket includes a connecting bump on one side so as to be inserted to the guide groove, and wherein the watch body is rotatable around the connecting bump and slidably movable with respect to the bracket along the guide groove.

3. The convertible smart watch of claim 2, wherein the guide groove is prepared by a pair at both sides of the watch body, and the bracket having connecting bump is prepared by a pair so as to be combined to the pair of brackets one to one, and the bracket is inserted to the groove or the through hole of the frame.

4. The convertible smart watch of claim 1 further includes a watch body locking unit for locking the watch body from being fallen from the groove or the through hole of the frame inadvertently, when the watch body is inserted to the groove or the through hole.

* * * * *